US006061039A

United States Patent [19]

Ryan et al.

[11] Patent Number: 6,061,039

[45] Date of Patent: May 9, 2000

[54] GLOBALLY-ADDRESSABLE MATRIX OF ELECTRONIC CIRCUIT ELEMENTS

[76] Inventors: Paul Ryan, 8445 Dunsinane Dr., Dublin, Ohio 43017; Dean E. Ryan, 5955 Lisa St., Columbus, Ohio 43231

[21] Appl. No.: 08/078,864

[22] Filed: Jun. 21, 1993

[51] Int. Cl.[7] ..... G09G 03/20

[52] U.S. Cl. ..... 345/55

[58] Field of Search ..... 345/30, 55, 76, 345/84, 87, 89, 90, 147; 340/825.35

[56] References Cited

U.S. PATENT DOCUMENTS

| | | | |
|---|---|---|---|
| 4,419,734 | 12/1983 | Wolfson et al. | 340/825.35 |
| 4,908,613 | 3/1990 | Green | 345/90 |
| 5,245,534 | 9/1993 | Waterhouse et al. | 340/825.35 |

FOREIGN PATENT DOCUMENTS

| | | | |
|---|---|---|---|
| 2627617 | 8/1989 | France . | |
| 2233469 | 1/1991 | United Kingdom | 345/90 |

*Primary Examiner*—Matthew Luu

*Attorney, Agent, or Firm*—Pollock, Vande Sande & Amernick

[57] ABSTRACT

A globally-addressable array of electronic circuit elements having distributed intelligence. Each circuit element location is connected to a common bus structure which can address each circuit element and transfer data to and from each element. Logic circuitry at each circuit element location recognizes data addressed to a respective circuit element location, and converts data received into an operating level for a respective transducer element. Data transfer to each element location can be made using conventional compression techniques. The data transfer can be bidirectional so that a sensed condition may be transferred from the location over the common bus structure.

16 Claims, 5 Drawing Sheets

NOTE: $\overline{\text{STORE}}^1$ IS FOR THE PIXEL HAVING ADDRESS 11001000; $\overline{\text{STORE}}^2$ IS FOR A PIXEL HAVING ANOTHER ADDRESS.

NOTE: ASSUMES AN 8 BIT ADDRESS SIZE.

GLOBALLY-ADDRESSABLE MATRIX OF ELECTRONIC CIRCUIT ELEMENTS

The present invention relates to arrays of electronic circuit elements. Specifically, a globally-addressable matrix of electronic circuit elements is described having intelligence located at each array position.

Electronic circuits are often configured in an array of elements disposed in an addressable matrix. These elements have a position within the matrix which identifies the element. Such arrays of electronic elements include memories, wherein each memory element is located in a matrix and has an address corresponding to its location within the matrix. The memory element can be a capacitor or other storage device for holding representations of a bit of information. Information is written to the memory element and read from the element by first addressing the element and then changing its state or reading its state.

Matrix arrays of pixel elements are used to form an image generating screen. Each of the pixel elements assumes a value representing the gray scale of a point on the image. When viewed from a distance, the array of pixels appears to provide a continuous image.

Conversely, a matrix array of sensing elements may be used as a scanning sensor for generating images. Each element represents a different point of an incident image. An image signal is produced by reading each sensing element sequentially.

These element arrays have in common the need to be addressable. Information is received from and transferred to an element of the array using an addressing scheme which will locate the particular element which is to receive or provide a particular piece of information. Once addressed, a data transfer to or from the element is effected.

The addressing schemes for the array of elements increases in complexity as the number of elements in the array increases. A limit on the number of elements in an array is reached due to the addressability problem. Conventionally, such elements are addressed by using multiple conductors, each of which is common to all the elements in a row of a matrix array, and a similar set of conductors, each of which is common to all the elements in a column of the matrix array. By selecting the right row conductor, and the right column conductor, it is possible to locate a specific matrix element for receiving data or for reading data to a common bus.

The practical limitations of array size are also encountered in applications which require that each element be refreshed on a periodic basis. In the case of image displays, wherein each element represents a pixel of an image, the element must be refreshed with new information so that the image retains its particular gray scale at each and every element location. Refreshing requires each element to be addressed, and new or the same data applied to the pixel generating element for maintaining the image intensity.

Similarly, in memory arrays, wherein a capacitor serves as a storage element, it is necessary to refresh the capacitance element at each array location as the charge representing the data stored at the location changes with time.

The continuing development of integrated circuit technology continues to decrease electronic component sizes. However, the interconnections between the devices remain a difficult performance-limiting circumstance. Densities for circuit components are approaching submicron levels, and quantum effects dramatically influence the reduction in size. The interconnections between elements introduce circuit anomalies which have adverse effects on the operation of the entire array.

The reduction in size of circuit elements provides an opportunity to simplify the interconnections with each circuit element, and provide intelligence at each location of the array element. With sufficient intelligence located at each array element, the element may be addressed over a common bus structure, and data execution may be done at the array element position. Data associated with each element position may then be introduced globally to all circuit elements, with only the addressed element responding to data applied to all elements.

The ability to globally address an array of circuit elements which include at each location intelligence to operate on commonly supplied data and execution commands lessens the interconnection problem, and also provides advantages in data throughput to each of the elements. Specifically, compression techniques may be employed in the globally-addressed array such as run length encoding for addressing multiple element locations that are to receive the same data in a single data transfer.

As the ability to increase intelligence at the array location increases due to advances in the shrinking of the size of electronic devices, more functions can be carried out at the element locations than was heretofore achieved. Specifically, in the flat panel display art, virtually all computations had to be done away from the element locations, with the result, corresponding to a voltage level representing color or gray scale information, transferred to the pixel element locations.

With the introduction of computing capabilities at the array location, certain graphics can be generated based on a single command given to all elements. As each element knows its location within the array, a command to draw a particular figure or segment could be executed locally at each array element location to derive the specific gray scale value for that location.

The principal of distributed intelligence can be applied to other array structures to permit computing functions currently done at a central location to be distributed in a globally-addressed array.

It is therefore an object of this invention to provide for a globally-addressable array of electronic circuit elements.

It is a specific object of this invention to provide distributed intelligence at each circuit element position in an array of electronic circuit elements.

It is yet another object of this invention to provide for computing capability at each electronic circuit element in an array of such elements which can be commonly addressed.

It is still another object of this invention to provide a display utilizing distributed intelligence at each pixel location of an array of pixels.

It is another object of this invention to provide for data compression for data transfers to an array of addressable electronic circuit elements.

SUMMARY OF THE INVENTION

These and other objects of the invention are provided by a globally-addressable matrix of electronic circuit elements. The invention provides at each circuit element location intelligence sufficient for recognizing commands which are addressed to a respective circuit element, as well as the ability to execute such commands.

The introduction of intelligence at each matrix position in the form of execution logic limits the necessity to address each position at regular frequent intervals. Thus, in applications such as image displays or in large-scale memories, the need to refresh each and every circuit element at all locations becomes less burdensome.

Global addressing of the individual picture elements eliminates much of the disadvantages inherent in row and column address structures. A data bus structure common to all elements of the matrix carries addresses as well as command data to each matrix element, eliminating the more complex row and column addressing of the prior art.

Common data compression techniques may be employed for increasing data throughput to the array elements. Run length encoding which takes advantage of the fact that a plurality of array elements are subject to the same command, may be employed to address groups of array elements. Run length encoded global commands may be given to all elements which are capable of executing such commands in a single data transfer cycle.

In one application of the device as an image display, a two-conductor bus connects all the pixel elements. One of the conductors serves as a clock line and the other serves as a data line. Addresses are transmitted as serial data to all the pixel elements over the data line. Only pixels recognizing an address will set a luminance level and color value in accordance with data which is placed on the data line following the address.

In yet another application of the device as a sensor, sensor elements may be located at each matrix position. The common bus may be used to address each position and read sensor information from the sensors. Further, the sensors can be configured to process a sensed condition before forwarding such data in response to a subsequent issued request.

DESCRIPTION OF THE PREFERRED EMBODIMENT

Figure 1:
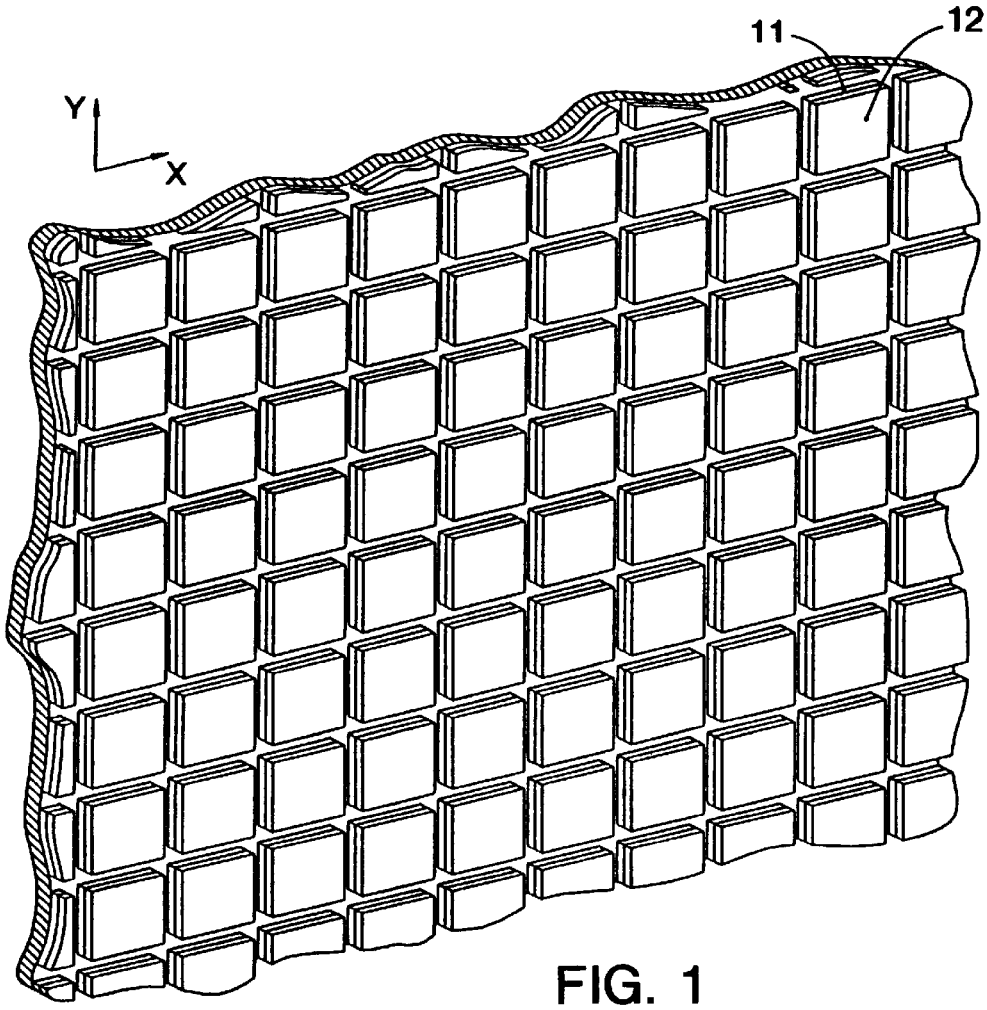
FIG. 1 is a plan view of an array for a flat panel display application having a global addressing facility.

Referring now to FIG. 1, there is shown an array of circuit elements 12 having a position in an X, Y coordinate system defined by rows and columns. The circuit elements 12 may be light-emitting elements of a flat panel image display. Associated with each circuit element location is a logic circuit 11 which provides for distributed intelligence over the array of electronic circuit elements. The image is generated by selectively illuminating each of the elements 12 to have a gray scale level corresponding to a point on an image being displayed. Alternatively, the circuit elements 12 could be sensor elements used to sense an incident image, applied force or other condition over an array of such sensors.

Figure 2:
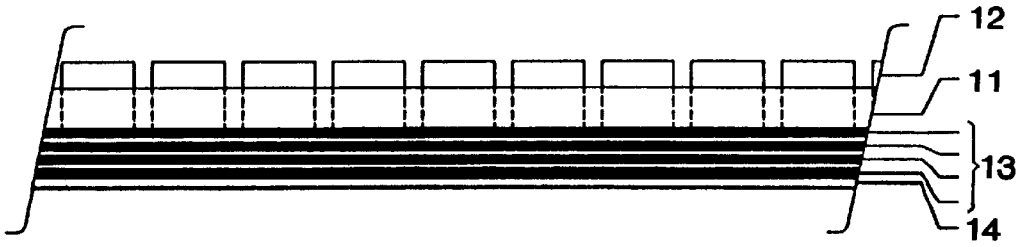
FIG. 2 is a section view of the array of FIG. 1, illustrating the common bus structure and display elements located in their array positions.

The array of circuit elements of FIG. 2 has a respective logic circuit 11 which provides for the distributed intelligence. Contrary to commonly-employed arrays of circuit elements, the circuit elements 12 have an addressing scheme which does not require a separate conductor for every column and row of array elements for addressing particular elements within an array. The current invention relies upon a common bus structure 13 connecting all the array locations for transferring data to and from the logic circuits 11 distributed over the array. Each location can be identified by a unique address which is transferred over the common bus structure 13. The common bus structure 13 is also used to transmit command data and attribute data. The transferred data—whether address data, command data or attribute data—is latched by an electronic circuit element 11. The electronic circuit element 11, recognizing the latched address data as its address, can utilize the latched command and attribute data for establishing a condition on a transducer element, such as a pixel-generating element 12.

The principle of having distributed intelligence over the array can be employed in a bi-directional mode. Rather than delivering data to each location of the various array elements, it is possible to transfer data from these array element locations over the common bus structure 13 to a central source for collecting and analyzing such data. This mode of operation would be employed when the distributed intelligence is used in an array of transducer elements which comprise sensors to detect various conditions over the surface of the array. Examples of such arrays are image sensors for providing a camera function, and pressure sensors which might be employed in either touch screen display technology or robot position sensing, etc.

The functions carried out at each location of the array may be as varied as data storage of multi-bit data, or the generation of images. As the size of logic circuitry 11 decreases due to technological advances, the ability to have command data execution at each array location is enhanced. Currently, matrix arrays of circuit elements rely on all processing to be done off the array. The results of processing and updating the values of signals for controlling each of the circuit elements of the array is transferred via the foregoing row column addressing scheme to each individual location of the array.

The foregoing globally-addressable array structure permits a single bus to serve all locations, with each location recognizing its address and any related data being forwarded over the bus structure. In certain image generation applications, wherein graphics are to be generated such that each pixel assumes the value for generating a point on the displayed graphic, it is possible to send commands over the bus structure 13 globally informing the pixels of a display character or segment to be displayed. The pixel locations may decode the global command, and since they are aware of their respective locations, participate in the image generation based on the command and position coordinate. Thus, if a circle were to be displayed, having a given radius with a given center point, a command defining the circle in terms of radius and center point would be interpreted by each pixel of the array. Those pixels recognizing their position as being involved in the segment generation would therefore generate the appropriate gray scale level for their respective position.

The digital techniques used to transfer pixel levels to each array position provides improved noise immunity over prior art analog circuits which employ X, Y addressing. Further, various error correcting schemes known in the digital communications art may be implemented as the level of intelligence located at each array position increases due to advances in the state of the integrated circuit technology art.

The implementation of an array such as is shown in FIG. 1 requires that there be at least a common connection, power voltage connection and a data and clock signal line connected to each location. FIG. 2 illustrates one possible configuration of an array bus structure which will supply these common signals to all element locations of the array. Using a multi-layer structure on a substrate 14, the power connection, common data line connection and a clock line may be implemented as layers of a multi-layer conductive package. The logic circuit 11 is connected to each of the conductors of the bus system 13.

Figure 3:
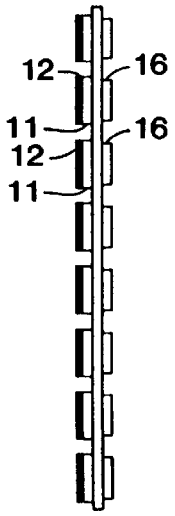
FIG. 3 is a side view of yet another embodiment of the array of electronic elements of FIG. 1, using an addressing scheme employing infrared carrier signals.
Figure 4:
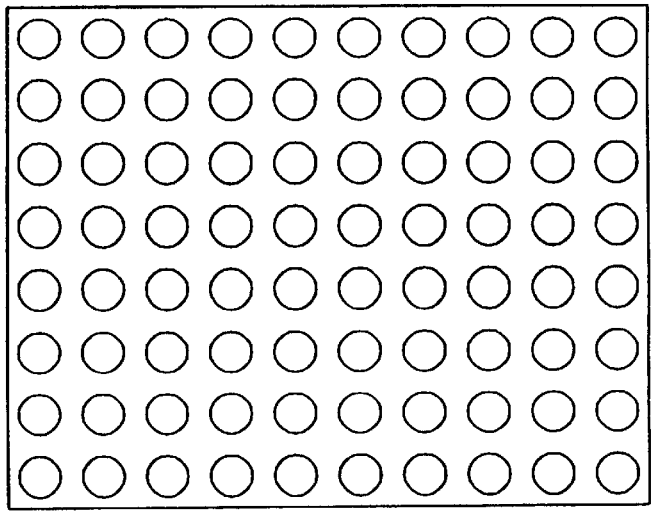
FIG. 4 is a front view of the device of FIG. 3.
Figure 5:
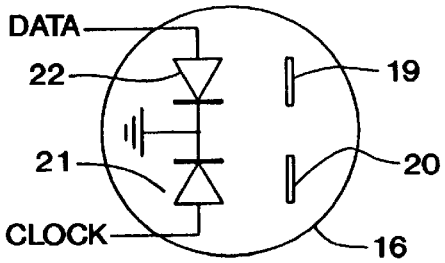
FIG. 5 illustrates the photodetector for detecting clock and data transmissions over the infrared carriers.
Figure 6:
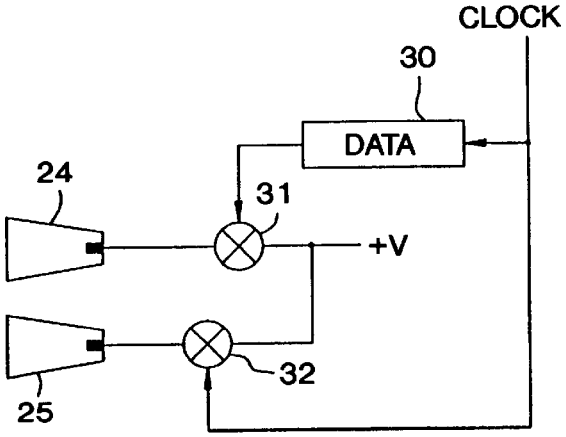
FIG. 6 illustrates a device for modulating clock information and data information over two multiplexed carriers.

It may also be possible to transmit the data and clock signals to each of the globally-addressable array positions using infrared carrier signals. Referring to FIG. 3, there is shown a side view of the array structure having on a reverse side of the array a photodetector 16 for each cell location. FIG. 4 shows the front view of the array of FIG. 3, looking rearwardly towards the array. By use of a pair of infrared carriers which illuminate all photodetectors 16 of the circuit element array, the same data and clock information may be conveyed to each array location. As FIG. 5 indicates, the photodetector 16 may include two photodetecting diodes 21 and 22 which have associated therewith infrared filters 19 and 20. Referring to FIG. 6, a pair of carrier signals are generated by the infrared signal generators 24 and 25, modulated with both clock signals with modulator 32, and with data signals with modulators 31. As the rear side of the array is flooded with the two carrier signals, modulated with each of the data and clock signals, it is possible to provide the separate data and clock signal to each cell location using the detector of FIG. 5.

Those skilled in the art will recognize other ways of configuring a common bus structure to each array location such that data appearing on the bus may be sensed at each array location, and acted on if an address is found corresponding to or related to a circuit element position.

Figure 7:
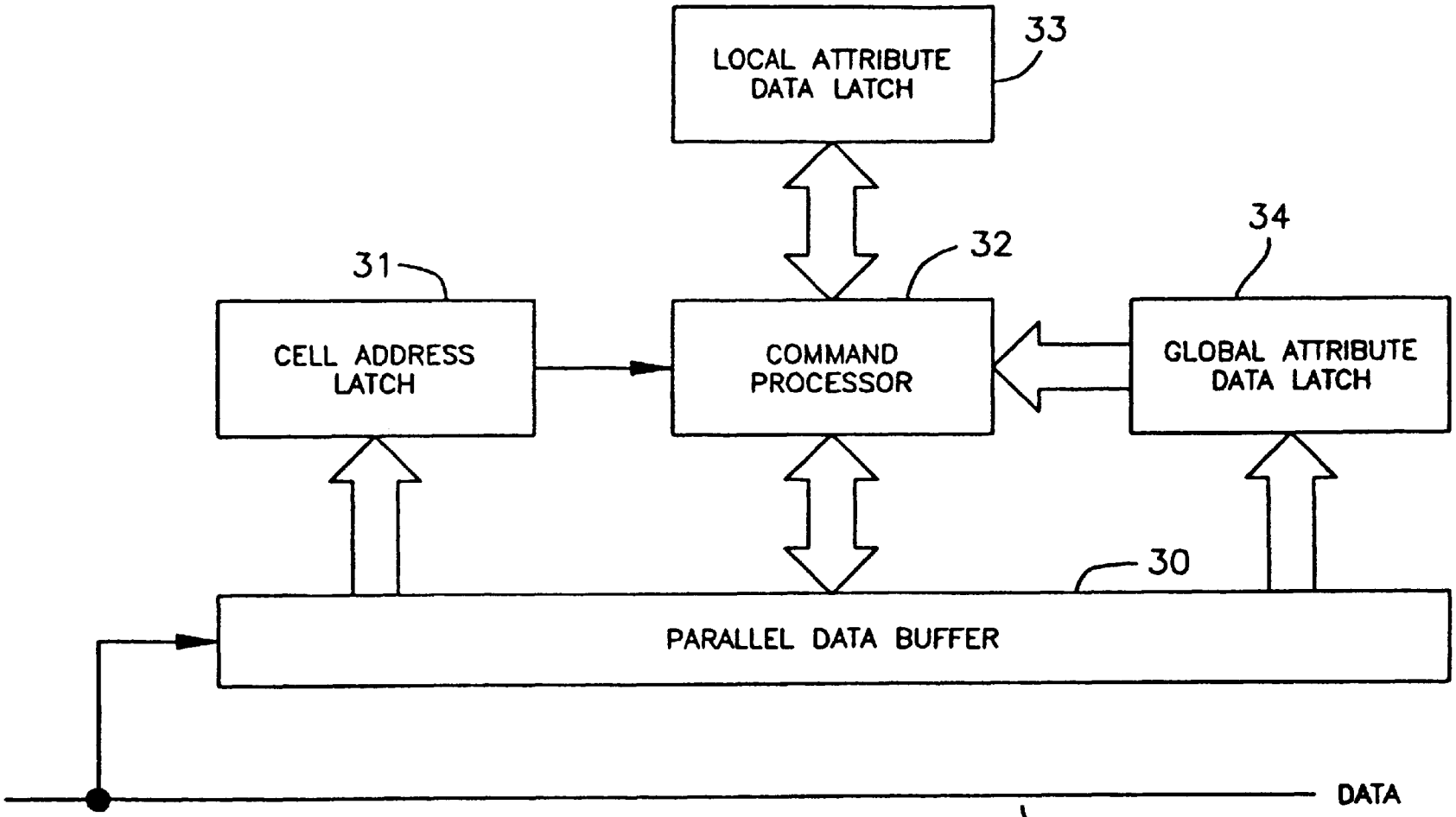
FIG. 7 illustrates the cell architecture located at each array position.

The logic circuitry at each array location may be viewed architecturally as is shown in FIG. 7. The common data bus 13 is connected to a serial to parallel data buffer 30 of each cell location. A cell address latch 31 is shown which will latch address data appearing on the data bus structure 13.

Data which follows the address latched in the cell address latch 31 may be processed in what is generically shown as a command processor 32. The command processor 32 may be dedicated logic, which can decode a command appearing in the parallel data buffer 30, and supply in response thereto either attribute data defining a condition for the circuit element of the array position, or otherwise controlling the circuit element. In the display mode of operation, this would in all likelihood be attribute information including a gray scale level on color information for the respective pixel generating transducer located at the array location. The data is shown as being latched in an attribute data latch 33, whereby it is available for setting the level of gray scale and color for the respective pixel.

The generic architecture of FIG. 7 is repeated at each array location. By having the location contain its own logic circuitry, the distributed intelligence is achieved at each array position location, permitting some processing to occur in the array itself rather than as has heretofore been the rule, off the array.

Figure 8:
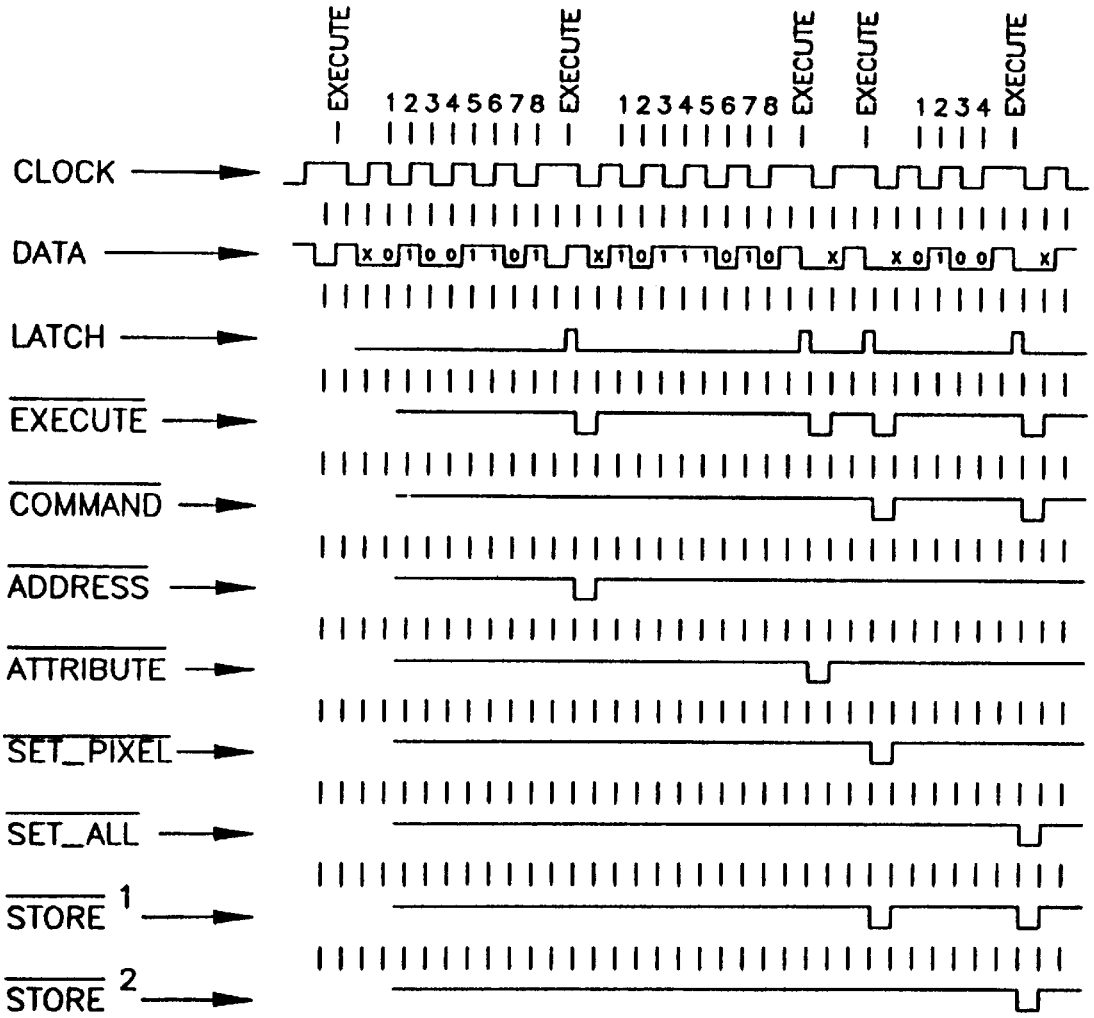
FIG. 8 is a timing diagram illustrating the operation of the device of FIG. 9.

As will be evident with respect to the preferred embodiment of FIG. 8, the architecture of FIG. 7 will permit efficient data transfer to each array location. It should also be evident that the architecture permits a bidirectional transfer from the array location to the data bus in sensor applications which require data to be received at each location and transferred to a common location.

Data Bus Structure Protocol

In implementing the foregoing embodiment as an image display panel, a particular data structure format has been devised which minimizes the amount of time required to address a given location, as well as the number of connections needed to each location.

The data is transferred in a serial format over a single conductor of the data bus 13. The serial data format includes as the last received bits the following command structure:

00 . . . command

01 . . . address

10 . . . attribute

11 . . . currently undefined.

Thus, to update a particular array location with new information relating to either a scene change or to initially create a graphic, the address of the pixel in binary form is serially transmitted. As the array is defined in X,Y coordinates, the form of the address would be as follows:

X0, Y0, X1, . . . , Xn, Yn, 01 where X0 is the last significant bit in the X portion of the address, and Xn is the most significant bit in the X portion of the address. In reality, if X is 0100 and Y is 0010, this would look like and be transmitted as 0001100001, with the left-most bits transmitted first. The address ID bits 01 are the last bits to be transmitted following the address.

The foregoing format permits the truncation of address data, such that all pairs of zeroes at the start of a multibit address transmission can be left off. Thus, the above example can be reduced to:

0001100001

01100001

The length of any message transmitted is reduced by trimming all the leading pairs of zeroes representing the lower order bits of an address, attribute or command.

The clock signal plays a role in the transmission of this address data. The clock cycle has the same frequency as the data rate, but is shifted 90° with respect to the data rate.

FIG. 8 illustrates the relationship between the clock signal and the data signal. Following the transmission of a message, the clock signal is held high for two data line transition's, thus indicating to the logic circuitry of each array position that the message is over. In the event less than a full width message has been sent, zeroes will be inserted for all lower order bits which are assumed to be missing.

The command message, having a message ID of 00, can be used as a SET PIXEL command for commanding the last addressed pixel to assume the state identified by the value of the last transmitted attribute data sequence. The command message may also be of a global nature which issues a SET ALL condition to all pixels to establish the same attribute level within all pixels. Thus, data compression results by avoiding sending redundant address data, and by truncating data that is known, that is, all pairs of leading zeroes.

The foregoing format lends itself to various additional data compression techniques. For instance, run length encoding may be implemented such that groups of pixels having the same gray scale level may be set from the same message. In this scenario, an address range may be sent over the data bus, identifying all pixels within a range which are to receive a common new attribute. Only those pixel locations which have data to be changed need be addressed. Additionally, the scheme lends itself to an indexing command which will command all pixels having an address within a certain range, to be updated in accordance with the last transmitted attribute data sequence.

The foregoing addressing scheme avoids the need to refresh every pixel location on a regular interval as is done in conventional scanned display panels. Only those pixel locations which have data to be changed need be addressed. Further, it may be possible to download pixel data before its display is required, which is later displayed in response to a command identifying the time for display. Further, the throughput is increased such that not all pixels need to be addressed during each frame time, thus permitting messages in their compressed format to be timely received by those pixel locations requiring updated information.

Figure 9:
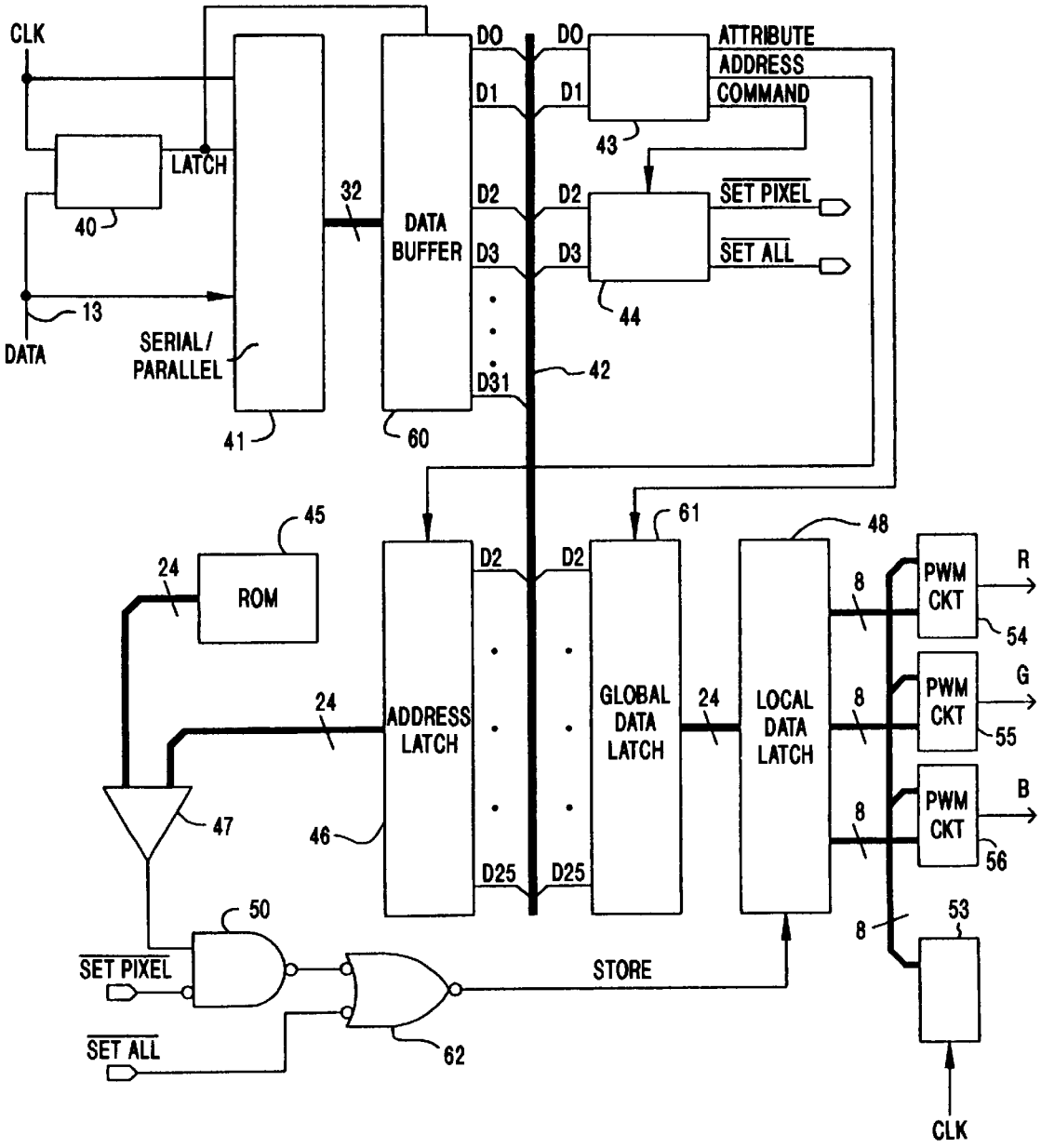
FIG. 9 illustrates logic circuitry in a display application which is located at each pixel location in the array.

A specific integrated circuit for carrying out the processing at each array location is shown more particularly in FIG. 9. FIG. 9 represents the preferred embodiment of a logic circuit to be located at each pixel location for generating R, G and B levels for driving a light-emitting diode array. The light-emitting diode array generates a composite color pixel level from the R, G & B output signals.

The preferred embodiment includes the common clock line and data line of the common bus structure 13 interconnecting all pixel locations. A latch circuit 40 is shown which, as illustrated in the timing diagram of FIG. 8, will provide a LATCH SIGNAL command at the end of a message. It should be noted that the clock is shifted 90° from the data interval, such that data can be latched for both a rising and falling edge of the clock line.

The serial to parallel converter 41 latches each received serial data bit. The serial/parallel converter shifts each bit which is received under control of the clock signal such that a full data width word is eventually latched in the serial/parallel converter 41.

The preferred data format described above sends the least significant bits of the address, command or attribute data first, followed by the ID data bits. The least significant bits, if they contain all zeroes, may be eliminated from transmission, and the serial/parallel converter will assume the non-transmitted bit positions are zero.

As shown in FIG. 8, the LATCH command is asserted during an execute sequence defined by the clock signal being held high for two data transitions. The serial/parallel converter is cleared upon assertion of the latch line such that all non-transmitted bits may be assumed as zero. The assertion of the latch line also latches the contents of the serial/parallel converter into data buffer 60 before the serial/parallel converter is cleared.

The last two bits transmitted will include bits D0 and D1 which are decoded in the decoders 43 as either attribute data, address data or command data.

Following the latching of data in the serial to parallel converter, the decoder 43 produces an output during the interval identified by EXECUTE of FIG. 9. In the event bits D0 and D1 are decoded as an address, the address register 46 is enabled, and latches the contents on data bus 42, representing bits D2 through Dn of the received serial data where n is the maximum word size less one. The contents of address register 46 are compared in comparator 47 with the local address stored in ROM 45. As each pixel location is identified by a unique address stored in ROM 45, it is possible to determine whether commands that follow should effect this pixel location which has identified its address in address register 46.

Should the output of decoder 43 determine that the data in data buffer 60 was an attribute, the ATTRIBUTE line will become asserted, enabling the global data latch 61 to latch the attribute value contained on the data bus 42 bits D2 through Dn. This global attribute will be remembered until a new attribute is received.

If the output of decoder 43 indicates that a command sequence was received, the COMMAND line becomes asserted enabling decoder 44. Decoder 44 determines what type of command is being executed by decoding the information on the data bits D2 through Dn. In the preferred embodiment, only two command types are shown, a SET PIXEL command that stores the last attribute into the last addressed pixel, and a SET ALL command that stores the last attribute into all pixels, regardless of address.

Assuming that a match is found in comparator 47 between the locally stored address in ROM 45 and the previously received address in the address register 46, a STORE command is initiated from gate 62 when the SET PIXEL command is received in the data buffer 60. This STORE command enables the local attribute latch 48 to store the last attribute latched in the global data latch 61 as the local attribute for this pixel.

The data register 48 also receives a STORE signal from gate 62 when a SET ALL pixels command is received in the data buffer 60. When the set all pixels command is received, the output of comparator 47 is ignored, thus setting the local attribute value regardless of the address of the pixel.

The local attribute data latched in register 48 is associated with the respective pixel location. This data is transferred to the inputs of the Pulse Width Modulation circuits 54, 55 and 56. The format of the attribute data is similar to the address data where the bits of the red, green and blue parts are interleaved, with the least significant bits being transferred first. This allows truncation of pairs of zeroes. Each color part is sent to one of the three pulse width modulator circuits.

In addition to truncating known attribute data (the zeroes at the beginning of the attribute message), the least significant bits of the attribute information could be truncated to increase data throughput by simply approximating the desired color.

Once the inputs of the pulse width modulation circuits 54, 55 and 56 have received the appropriate color information from the local attribute data latch 48, the clocking circuit 53 will provide a reference signal to allow the pulse width modulation circuits 54, 55 and 56 to generate a pulse width modulated output for each of the R, G and B levels, which when averaged by a pixel generating diode array 12, produces a composite color pixel.

Thus, there is illustrated with respect to one particular embodiment, how the distributed intelligence at each array location can be advantageously used in a display application. It is also clear from the foregoing description that instead of generating a level of luminance, it would be possible by those skilled in the art to read transducer values located in an array, and forward such to the common bus structure 13 for analysis by the central processor. The use of distributed intelligence is therefore bidirectional, as will be recognized by those skilled in the art.

The foregoing two-dimensional display panel may also be implemented in a three-dimensional embodiment. The unique addressability of each array element permits a third dimension, constituting a cubical array of addressable elements to be configured. Access to these three-dimensional elements can be obtained by an address in the form of (X, Y, Z).

Thus, with respect to one embodiment, there has been described an array of electrical elements which may be globally addressed, avoiding the complications of the necessity to individually address each location. Those skilled in the art will recognize yet other embodiments from the claims which follow.

What is claimed is:

1. A globally-addressable pixel array comprising:

a matrix of pixel elements, each pixel element having a different location which includes:

a logic circuit having a unique address which identifies its location for storing data representing the gray scale of said pixel element;

a common data bus interconnecting each logic circuit of every pixel location; and, means for accessing said logic circuits over said common data bus structure interconnecting said pixel element locations for transferring gray scale data to each of said pixel locations.

2. The globally-addressable pixel array of claim 1 further comprising:

execution logic at each pixel element location for altering said pixel element gray scale based on data received from said common data bus.

3. The globally-addressable pixel array of claim 1 wherein said means for accessing comprises light detecting means at each logic circuit location for receiving address data and gray scale data which is modulated on a light beam.

4. The globally-addressable pixel array of claim 3 wherein said light detecting means provides first and second signals constituting respectively a data signal and a clock signal to said logic circuits.

5. The globally-addressable pixel array of claim 3, wherein said means for accessing comprises a light beam source modulated with said gray scale data.

6. The globally-addressable pixel array of claim 1 wherein said data is transmitted over said common bus as address data and command data with at least two bits of data defining the data as address data or command data.

7. A globally-addressable pel array forming an image display comprising:

a plurality of light-emitting elements disposed in a matrix;

addressable logic circuitry located at each light-emitting element location for storing data having an address associated therewith unique to said location which establishes a gray scale level for a respective light-emitting element; and, a common data bus means interconnecting all of said addressable logic circuitry for transferring command and address data to all of said logic circuitry for establishing said gray scale level at one or more addressed locations.

8. The globally-addressable pixel array of claim 7 wherein said addressable logic circuitry includes execution logic for generating red, green and blue values for said light-emitting elements based upon said command data.

9. The globally-addressable pixel array of claim 7 wherein said addressable logic circuitry comprises:

serial to parallel conversion means for converting data received on said common data bus means to parallel multibit data;

decoder means for determining whether said data is address or attribute data;

an address register connected to receive said parallel multibit data in response to a determination that said data is address data;

means for determining whether an address received in said address register is equivalent to an address of a respective light-emitting element; and, a data register for storing said attribute data received on said data bus means when an equivalent address is received in said address register.

10. The globally-addressable pixel array of claim 9 further comprising:

pixel register means for receiving said data register contents; and, means connected to said pixel register for converting said pixel register means contents into a value of light intensity for said light-emitting element.

11. The globally-addressable transducer array of claim 10 wherein said pixel register means provides R, G and B signals for said light-emitting element.

12. The addressable pixel element comprising:

a light emitting element;

logic circuitry dedicated to said light emitting element, for receiving pixel values representing a gray scale level for said light-emitting element;

means for addressing any one of said logic circuitry of said array and supplying said pixel values to said any one logic circuitry comprising a pair of conductors interconnecting each pixel element, one of said conductors comprising a clock signal line and the other connected to supply serial pixel address data and serial pixel gray scale data to said logic circuitry.

13. The addressable pixel element of claim 12 wherein said logic circuitry includes:

means for detecting an address on said one conductor which corresponds to said one pixel element; and, means for storing pixel data received from said one conductor when said address is detected.

14. The addressable pixel element of claim 13, wherein said means for detecting an address determines from a range of addresses on said one conductor whether pixel data received on said one conductor is to be stored at said pixel element.

15. The globally addressable pixel array of claim 2, wherein said execution logic alters the state of said pixel element gray scale based on its relative location in said array.

16. The globally-addressable pixel array of claim 2, wherein said means for accessing said logic circuits comprises:

an addressing means for addressing a plurality of logic circuits over said common bus structure which are to receive a common gray scale value; and means for transferring said common gray scale value over said common bus structure to all said logic circuits, whereby only said plurality of addressed logic circuits store said common gray scale level.

* * * * *